US006584716B2

(12) United States Patent
Paul

(10) Patent No.: US 6,584,716 B2
(45) Date of Patent: Jul. 1, 2003

(54) VANDAL RESISTANT SIGN AND METHOD

(75) Inventor: David LeRoy Paul, Wolcott, NY (US)

(73) Assignee: Permar Systems, Inc., Wolcott, NY (US)

( * ) Notice: Subject to any disclaimer, the term of this patent is extended or adjusted under 35 U.S.C. 154(b) by 61 days.

(21) Appl. No.: 09/759,862

(22) Filed: Jan. 12, 2001

(65) Prior Publication Data

US 2002/0092219 A1 Jul. 18, 2002

(51) Int. Cl.[7] ..... G09F 7/02
(52) U.S. Cl. ..... 40/618; 40/612
(58) Field of Search ..... 40/618, 612, 628, 40/629, 585

(56) References Cited

U.S. PATENT DOCUMENTS

| | | | | | |
|---|---|---|---|---|---|
| 1,368,144 | A | * | 2/1921 | Haughwout | |
| 1,502,782 | A | * | 7/1924 | Johnston | |
| 1,718,622 | A | * | 6/1929 | Zeller | 40/618 |
| 1,785,145 | A | * | 12/1930 | Roll | 40/618 |
| 1,994,937 | A | * | 3/1935 | Berger | 40/612 |
| 2,167,838 | A | * | 8/1939 | Hand | 40/618 |
| 2,597,003 | A | * | 5/1952 | Johnson | 40/612 |
| 2,732,644 | A | * | 1/1956 | Graf | |
| 4,682,430 | A | * | 7/1987 | Ramsay | 40/618 X |
| 5,669,166 | A | * | 9/1997 | Verret | 40/603 |

FOREIGN PATENT DOCUMENTS

| | | | | |
|---|---|---|---|---|
| DE | 2713753 | * | 10/1977 | 40/618 |
| GB | 324568 | * | 1/1930 | 40/618 |

* cited by examiner

*Primary Examiner*—Joanne Silbermann
(74) *Attorney, Agent, or Firm*—Stephen B. Salai, Esq.; Roger Aceto, Esq.; Harter, Secrest & Emery LLP

(57) ABSTRACT

A vandal and weather resistant sign is disclosed including a support plate having a plurality of regularly spaced rectangular openings and replaceable tiles carried by and fixed to the plate. The plate is adapted to be fixed to a mounting surface such as a utility pole or the like with the reverse face of the plate against the mounting surface. The tiles are fixed to the reverse face of the plate wherein indicia on the obverse face of the tile is visible through the plate openings. The edges of the tile are concealed and protected by the plate so as to make the tile edges less susceptible to attack by vandals.

9 Claims, 3 Drawing Sheets

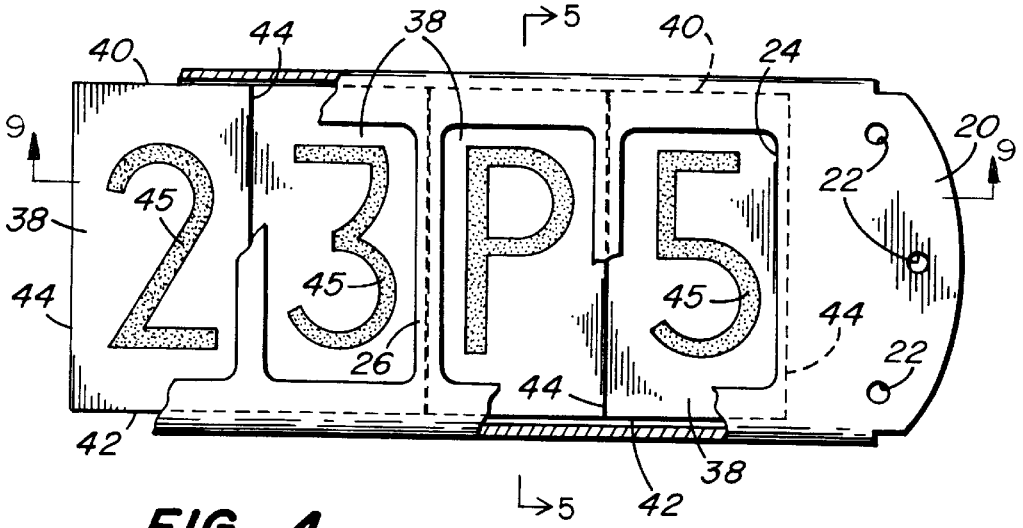
FIG. 4
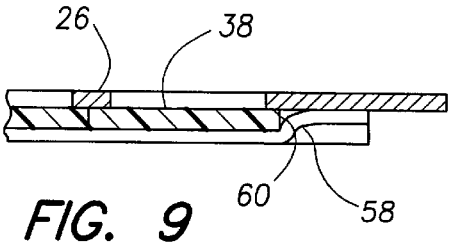
FIG. 9
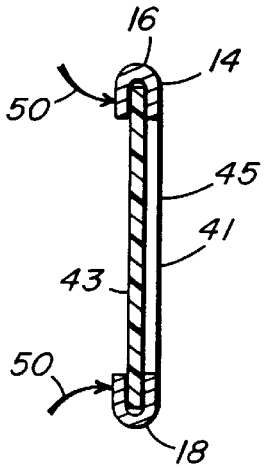
FIG. 5
FIG. 6
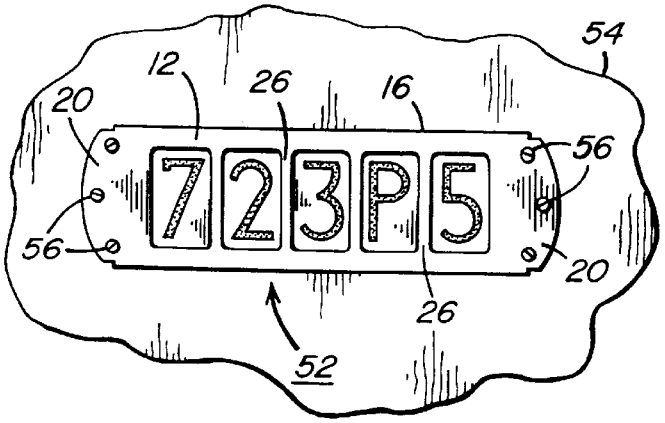

VANDAL RESISTANT SIGN AND METHOD

TECHNICAL FIELD

The present invention relates to a vandal resistant sign as may be used to mark utility poles, transformer enclosures, monuments and other like public or private structures.

BACKGROUND OF THE INVENTION

Utility poles placed along a public right of way are usually identified by some sort of signage, such as a tag or other marker, attached to the pole. The signage may perform any one of several important purposes including, but not limited to, uniquely identifying the pole so that maintenance personnel can determine the installation date or age of the pole, the voltage in the power lines supported by the pole or a combination of such information. For example, a code composed of a multi letter designation or multi digit number or a combination of letters and digits on a tag attached to the pole easily identifies a pole downed by storm. This speeds repair of the downed pole. A code identifying the voltage of the power lines supported by the pole to be determined clearly would be important to a repairman working on such lines.

The tag may be attached to a pole after the pole is erected. For this reason the tag is constructed so that it is versatile. In this respect a tag, bearing the appropriate code designation is assembled in the field from an inventory of parts. In a common construction, the inventory includes a first component comprising a plurality of flat, elongated plates. Each plate has its longitudinal edges folded over the obverse face of the plate thereby forming two parallel channels.

A second component in the inventory comprises a plurality of flat, generally rectangular tiles. The obverse face of each tile is provided with a single number, letter or other identifying indicia, usually by embossing. The tiles are of a size such that they can be slidably inserted into the channels on the plate with the indicia visible.

Once the pole is erected, tiles are selected and are arranged in the appropriate order to provide the coded designation. The tiles are then mounted to the plate by sliding them in the desired order into the channels on the plate. The tiles are placed with the reverse face of each tile being located against the obverse face of the plate so the code designation provided by the tile sequence is visible. The tiles in the sequence are abutted side-by-side and then the folded over edges of the plate are crimped to fix the tiles in position. The assembled tag is then attached to the utility pole by nailing or screwing.

A problem of tags constructed in this manner is that the longitudinal edge of the plate that is folded over to form the parallel channels is exposed on the obverse face of the assemble tag. The abutted side edges of the tiles also are exposed. Thus, all the channel and tile edges are exposed to the elements. These exposed edges also provide sites for vandal attack. For example a pry is easily forced under one or more of the exposed edges to effect the removal of the tiles. Removing or defacing of tiles alters the coded sequence and destroys the identification.

Another drawback of prior art tags is that the indicia are difficult to read from a distance unless the indicia are in a contrasting color to the color of the tiles. This means either painting the indicia on the tiles or coloring the embossed indicia. In either case, applying the indicia in a contrasting color adds steps to the manufacturing process and to the cost of the tiles.

Accordingly, it is an object of the present invention to provide a vandal resistant sign that may be assembled in the field.

Another object of the invention is to provide a vandal resistant sign that is assembled from an inventory comprising support panels and a plurality of indicia bearing tiles.

A further object of the invention is to provide a vandal resistant sign comprising a support panel and replaceable tiles fixed to the panel wherein no tile edge is exposed to view.

Yet another object of the invention is to provide a vandal resistant sign comprising a support panel and replaceable tiles fixed to the panel including structure integral the panel for protecting all the exposed edges of the tiles.

Another object of the present invention is to provide a vandal resistant sign that having easily read indicia.

Still another object of the invention is to provide a method of assembling a vandal resistant sign composed of a panel and replaceable tiles on the panel that protects all exposed edges of the tiles on the panel.

SUMMARY OF THE INVENTION

In accordance with the present invention, a sign is provided for attachment to utility poles and the like which may be assembled in the field from an inventory of components including a support panel and a plurality of tiles fixed to or carried by the support panel. Both the panel and tiles are preferably made of an aluminum alloy, preferably a 0.025 inch thick (0.635 mm) Aluminum 3003, H-14. While aluminum is preferred, other suitable materials including other metals such as steel or a plastic material may be used.

The support panel is an elongated plate having a plurality of rectangular openings equally spaced along the plate. Top and bottom longitudinal edges of the plate are bent and folded over the reverse face of the plate. These bent edges define parallel channels for receiving the top and bottom edges of rectangular tiles that are slidably received into the channels and against the reverse face of the plate. Each tile carries an alpha-numeric character on its obverse face. The characters may be applied by any suitable means such as by painting, printing or etching. Preferably, the characters are embossed in the tiles and may be colored with contrasting colors for the characters and the background. In an alternative embodiment the characters are cut into the aluminum or plastic tiles to form a stencil so the character takes on the contrasting color of the background surface to which the sign is attached. For example, if the sign is attached to a wooden utility pole, the characters appear dark in contrast to the tile which are preferably light colored, either natural aluminum, lightly anodized, or painted a light color.

Tiles having the appropriate alpha-numeric sequence are slid into the channels and lateral side edges of adjacent tiles are butted one against another. Although the tiles are carried on the reverse face of the plate, the obverse face of each tile faces outward through one of the panel openings. The tiles oriented in this position are then fixed in place, preferably by crimping the material of the channel against the reverse face of the tile, or adjacent the outer edges of the outer-most tiles. In the assembled sign, the entire peripheral edge of each tile is concealed and protected by the material of the plate surrounding each opening.

Accordingly, the present invention may be characterized in one aspect thereof by a vandal resistant sign attachable to a utility pole or other support comprising:

a) a generally flat plate having obverse and reverse faces, the plate being adapted for attachment to a mounting surface with its reverse face against the mounting surface;

b) the plate having a plurality of regularly spaced side-by-side rectangular openings separated by transverse molding strips;

c) a plurality of interchangeable generally rectangular tiles, each tile having top and bottom edges, generally parallel lateral side edges and an obverse face including indicia representing an alpha-numeric character;

d) each of the tiles having a width as defined between the lateral side edges that (i) is greater than the width of a plate opening and (ii) less than or approximately equal to the total width of a plate opening together with an adjacent transverse molding strip;

e) means on the reverse face of the plate and engageable with the tile top and bottom edges for holding tiles against the reverse face of the plate, the tiles being positioned in side-by-side relationship such that the indicia on the tile obverse face shows through the openings while the top and bottom edges are concealed by the plate obverse face; and f) the side-by-side tiles having the abutting lateral side edges of adjacent tiles concealed and protected by the transverse molding strips, whereby the concealment and protection of the edges of the tile by the plate and transverse molding strips reduces the exposure of the edges of the tiles to vandal attack.

In another aspect, the present invention may be characterized by a method of forming a vandal resistant sign comprising:

a) providing (i) an elongated flat plate having obverse and reverse faces and a plurality of regularly spaced side-by-side generally rectangular openings wherein the spaces between the openings define transverse molding strips and the reverse face of the plate having an upper guide channel extending along the plate above the openings and a lower guide channel extending along the plate below the openings, and (ii) a plurality of generally rectangular tiles, each tile having an alpha-numeric indicia on an obverse face, top and bottom edges and parallel lateral side edges wherein the width of each tile as defined between the side edges is greater than the width of an opening and less than or approximately equal to the combined width of an opening and an adjacent transverse molding;

b) mounting a plurality of tiles to the plate by inserting the top and bottom edge of each tile into the upper and lower guide channels respectively with the obverse face of each tile against the reverse face of the plate and sliding the tiles into the guide channels;

c) abutting the lateral side edge of one tile to the lateral side edge of an adjacent tile;

d) locating the abutting tiles relative to the openings such that the indicia on each tile is associated with and visible through one of the openings while the abutting tile edges are concealed behind the transverse molding strips;

e) fixing the tiles in position; and f) attaching the plate to a support surface with the reverse face of the plate against the support surface, whereby the indicia is visible through the opening whereas the edges of the tiles are concealed and protected by both the transverse molding strips and the portion of the plate obverse face adjacent the openings, such concealment and protection inhibiting exposure of the tile edges to vandal attack.

DESCRIPTION OF THE DRAWINGS

FIG. 4 is a front elevation view, partly broken away and in section of the assembled sign of the present invention;

FIG. 5 is a view taken along lines 5—5 of FIG. 4;

FIG. 6 is a view on a smaller scale showing the assembled sign of the present invention affixed to a support surface;

FIG. 8 is a view on a smaller scale showing a portion of the assembled sign of FIG. 7 attached to a support surface such as a utility pole or the like; and FIG. 9 is a sectional view taken along lines 9—9 of FIG. 4.

DETAILED DESCRIPTION OF THE INVENTION

Figure 1:
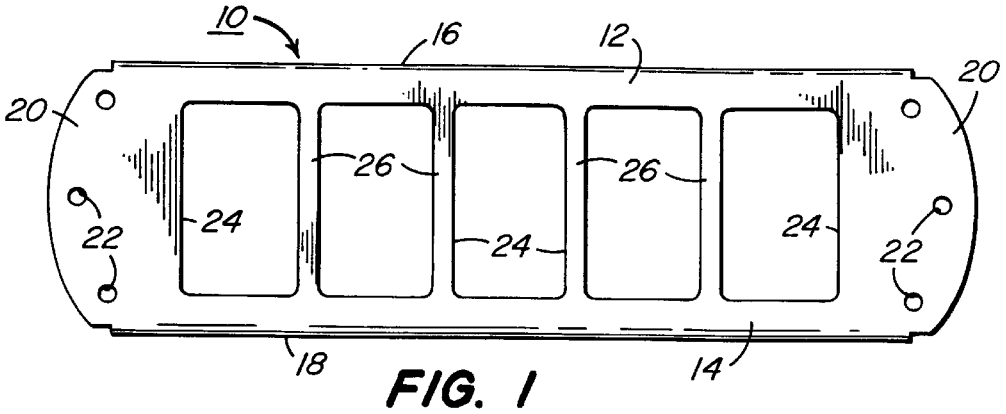
FIG. 1 is a front elevation view of one component of the present invention.

Referring to the drawings, FIG. 1 shows a first component of the invention generally indicated at 10. This first component 10 is an elongated preferably generally flat plate 12 formed of aluminum, steel or other suitable metal or plastic. The plate typically is relatively thin and malleable and has an obverse face 14, top and bottom longitudinal edges 16 and 18 respectively and opposite end portions 20. The opposite end portions 20 are preferably slightly rounded or chamfered and are provided with holes 22 for accommodating screws, nails or other fasteners (not shown).

The plate 12 is provided with a plurality of regularly spaced side-by-side generally rectangular openings 24. Transverse bars or molding strips 26 of equal width separate the openings 24. While rectangular openings are preferred, other shapes, portions of which may be curved or angled may also be used with compensating changes to the transverse bars.

Figure 2:
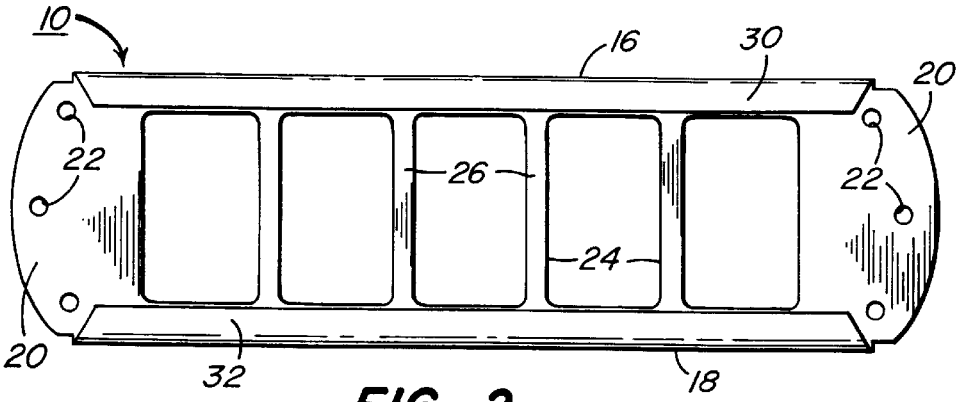
FIG. 2 is a rear elevation view of the component of FIG. 1.
Figure 3:
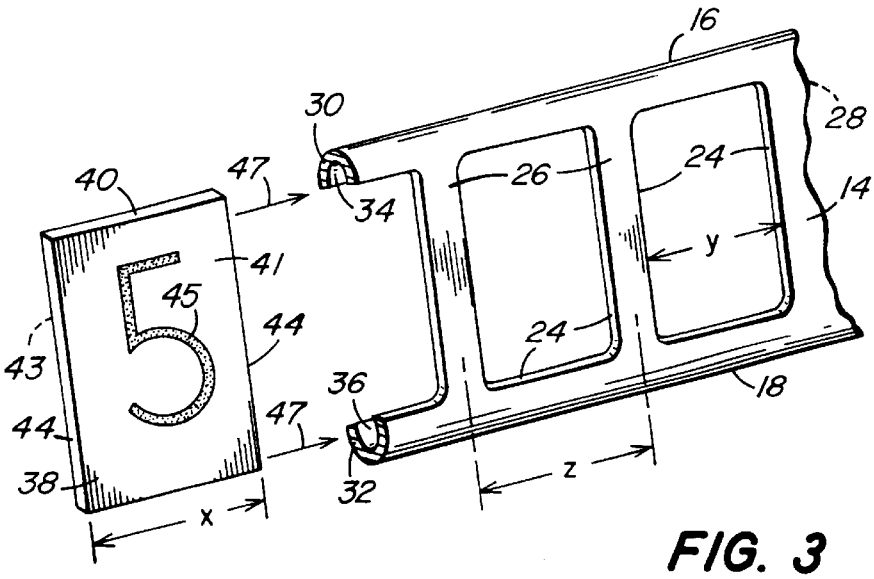
FIG. 3 is a perspective view showing a step in the assembly of the sign of the present invention.

As viewed in FIG. 2, the plate 12 has a reverse face 28. On the reverse face and extending along the top and bottom edges 16,18 of the plate are open channels 30,32 respectively. These channels may be separate pieces attached to the plate reverse face but preferably they are formed by folding longitudinally extending portions of the plate back over the reverse face 28. As best seen in FIG. 3, this forms the channels 30,32 such that their respective openings 34,36 are in facing relationship.

A second component of the invention, includes a plurality of tiles 38, one of which is shown in FIG. 3. Each tile 38 is generally rectangular having a top edge 40, a bottom edge 42 and lateral side edges 44. Each tile, like the plate 12, preferably is formed of a thin malleable metal or plastic.

While generally rectangular tiles are preferred, portions of the peripheries of the tiles may be curved or angled as long as compensating changes are made to the openings 24 and molding strips 26.

The tile height between its top and bottom edges 40,42 is sufficient to allow each tile to slide into the channels 30,32 as illustrated by arrows 47 in FIG. 3. The width "x" of each tile, as defined between is lateral side edges 44, is greater than the width "y" of each plate opening and less than or approximately equal to the distance "z" as measured from the midpoint of one transverse molding strip 26 to the midpoint of an adjacent strip 26. In the situation where all transverse molding strips 26 are of equal width, the tile width "x" is no less than the total width of a plate opening 24 plus the width of an adjacent transverse strip 26.

Each tile 38 has an obverse face 41 and a reverse face 43. The tile obverse face 41 is provided with an alpha-numeric character or indicia 45. The indicia may be applied by any suitable means such as by painting or etching. Preferably the indicia is embossed in the tile.

In assembling the sign of the present invention, tiles 38 are selected from an inventory and are arranged in a desired coded sequence. The coded sequence, for example, may uniquely identify a utility pole to allow its age or the type of voltage carried by the pole or a combination of such information to be determined. The tiles are then inserted into the channels by sliding the top and bottom edges 40,42 of each tile into the upper and lower channels 30,32 respectively. The tiles are slid into place with the obverse face 41 of each tile against the plate reverse face 28 and the lateral side edge 44 of one tile abutting the lateral side edge 44 of an adjacent tile.

As best seen in FIG. 4, the tiles 38 are located along the channels and positioned so that the indicia 45 on each tile is visible through a plate opening 24. When the tiles are in a proper position, the top and bottom edges 40,42 of each tile are concealed and protected behind the obverse face 14 of the plate. Likewise, the lateral side edges 44 of each tile are concealed and protected behind the plate transverse molding strips 26 and plate end portions 20. The tiles are then fixed in this position, preferably by crimping the channels against the tile reverse face 43 as shown by arrows 50 in FIG. 5, or by crimping through the channels adjacent the outside edges of the endmost tiles.

Crimping adjacent the outside edges of the outermost tiles is shown in FIG. 9. In this respect, after the tiles 38 have been placed in a proper array and are slid to a longitudinally adjusted position in the channels, a crimp 58 is formed in the channel adjacent the outside edge 60 of the outermost tile 38 in the array. In this fashion, crimps 58 at each end of the array of tiles serves to hold the array in the proper position for viewing the indicia through the openings 24.

FIG. 6 shows the assembled sign generally indicated at 52 attached to a utility pole or other support surface 54 by fasteners 56 inserted through the holes 22 in the plate end portions 20 (FIG. 1). The plate reverse face 28 (not shown in FIG. 6) is flush against the support surface 54 so the channels 32,34 below top and bottom plate edges 16,18 respectively, are not exposed. This protects the channels from vandal attack and reduces the likelihood of a pry being forced under the channels to open them for removal of the tiles. In a similar fashion, all edges of the tiles are concealed and protected behind the plate 12, which renders the tile edges less susceptible to vandal attack, and protects the edges from the detrimental effects of harsh weather conditions. While it still may be possible to force a tool under one or more of the transverse molding strips 26, prying up the strips does not provide access to the tile edges unless a strip is broken so the removal of a tile is less likely to occur.

Figure 7:
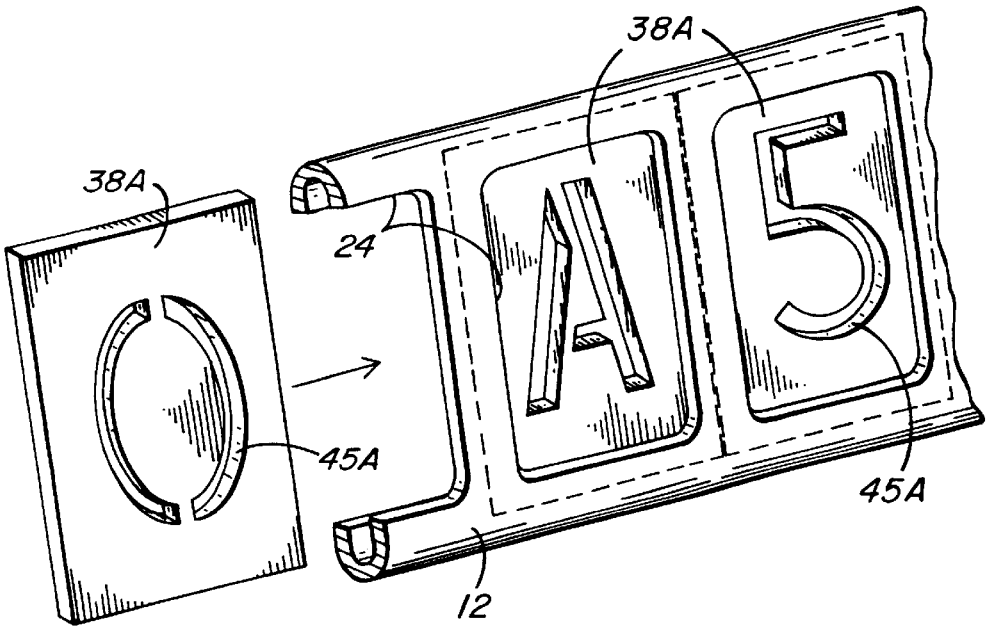
FIG. 7 is a view similar to FIG. 3 only showing another embodiment of the invention.
Figure 8:
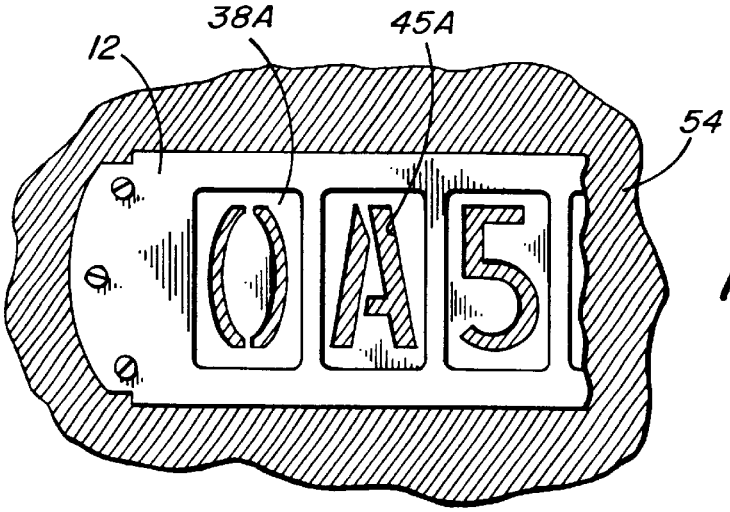

The embodiment as shown in FIGS. 7 and 8 utilize a different tile construction. In this respect, FIG. 7 shows that the tiles 38A are in the form of stencils wherein the characters 45A have been cut or stamped through the tiles. When assembled and attached to a support surface 54 as shown in FIG. 8, the color of the support surface shows through the stencil tile. The contrast of the tile with background color showing through the cut through character renders the indicia more pronounced and visible as opposed to an uncolored or unpainted embossed indicia. Accordingly, the stencil tile accomplishes an improvement in contrast as compared to an unpainted embossed character and comparable to a painted or printed character without the need for a separate printing or painting step in the manufacturing process. The improvement in contrast provided by the stencil tile is achieved because the plate openings 24 allow color of the support surface 54 to show through the plate.

Thus, it should be appreciated that the present invention accomplishes its intended objects in providing a vandal resistant sign that is easily assembled in the field. The sign is assembled from an inventory of plates 12 and a plurality of replaceable tiles 38. The structure of the plate including the channels 30,32 on the plate reverse face 28 and the regularly spaced openings 26 allow the tiles to be supported on the plate reverse face while rendering the indicia visible and at the same time concealing and protecting the edges of the tiles. The use of stencil tiles as shown in FIGS. 7 and 8 provide a more visible character with out the need for making the character a contrasting color to the background. While the stencil tile is shown in combination with the plate 12 as described herein, it can also be used with a conventional plate as described in the background of the invention provided the tile and plate are of contrasting colors.

While the invention has been described in connection with a presently preferred embodiment thereof, those skilled in the art will recognize that certain modifications and changes may be made therein without departing from the true spirit and scope of the invention, which accordingly is intended to be defined solely by the appended claims.

Having thus described the invention in detail, what is claimed as new is:

1. A vandal resistant sign attachable to a utility pole or other support surface comprising:

a) a flat plate having obverse and reverse faces, said plate being adapted for attachment to a support surface with its reverse face against said support surface;

b) said plate having a plurality of regularly spaced side-by-side rectangular openings wherein the spaces between said openings define transverse molding strips;

c) a plurality of interchangeable tiles, each tile having top and bottom edges, generally parallel lateral side edges and an obverse face including indicia representing an alpha-numeric character;

d) each of said tiles having a width as defined between said lateral side edges that (i) is greater than the width of a plate opening and (ii) less than or approximately equal to the width of a plate opening and an adjacent molding together;

e) said plate has top and bottom longitudinal edges and a portion of said plate including said top and bottom edges being bent back over the reverse face of said plate to form parallel open channels that are in facing relationship, said channels slidably receiving said tile top and bottom edges respectively and allowing the longitudinal adjustment of a plurality of said tiles to form an abutting side-by-side array against the reverse face of said plate and the longitudinal adjustment of the array with respect to the channels being in a position such that the indicia on each said tile obverse face shows through one of said openings while said tile top and bottom edges are masked by said plate obverse face;

f) said tiles when in said abutting side-by-side array having the abutting lateral side edges of adjacent tiles concealed by said molding strips, whereby the concealing of the edges of said tile by said plate and molding strips reduces the exposure of the edges of the tiles to vandal attack; and g) each of the channels having a crimp at an outermost edge of each of the tiles at each end of the array for fixing said array of tiles in said longitudinal adjusted position, each crimp being formed after slidably receiving the top and bottom edges of the tiles into the channels.

2. A vandal resistant sign as set forth in claim 1 wherein said plate and tiles are metallic.

3. A vandal resistant sign as set forth in claim 2 wherein said alpha-numeric indicia is embossed on said tiles.

4. A vandal resistant sign as set forth in claim 1 wherein said alpha-numeric indicia is formed by cutting through each tile so as to form a stencil of said tile.

5. A vandal resistant sign as set forth in claim 1 wherein said plate includes opposite end portions adapted to receive fasteners for attaching said plate to a said support.

6. A vandal resistant sign comprising:

a) a plurality of tiles, each tile having an obverse and a reverse face, and each tile having generally parallel side edges defining the width of said tile, a top edge and a bottom edge;

b) readable indicia on the obverse face of each of said tiles;

c) an elongated flat plate attachable to a support surface, said plate comprising a crimpable metal having opposite first and second longitudinal edges;

d) means on a reverse face of said flat plate for receiving said tiles, said means comprising portions of said plate extending along said opposite longitudinal edges that are folded back over the reverse face of said plate to form first and second open channels wherein said channel openings are in facing relationship one to the other for slidably receiving said tile top and bottom edges respectively of a plurality of said tiles butted side-to-side one against another to form an array with said tile obverse face of each tile in the array resting against said plate reverse face;

e) said plate having a plurality of regularly spaced openings and the portion of said plate between adjacent openings forming a transversely extending molding strip;

f) said openings each having a width as defined by the distance between said molding strips that is narrower than said tile width such that the resulting size of each opening is smaller than a tile whereby each opening is large enough to expose substantially the entire indicia on said tile obverse face while the entire outer periphery of each tile in the array is concealed by the portion of the plate and molding strips surrounding the opening thereby rendering said tile edges less susceptible to vandal attack; and g) a crimp in each of said channels, the crimps being located at an outermost edge of the tiles at the opposite ends of the array for fixing said array of said tiles in a longitudinally adjusted position, each crimp being formed after slidably receiving the top and bottom edges of the tiles into the channels.

7. A vandal resistant sign as set forth in claim 6 wherein said indicia are embossed.

8. A vandal resistant sign as in claim 6 wherein said tiles have cut openings that form said indicia as a stencil such that said support surface appears through said cut openings.

9. A method of forming a vandal resistant sign comprising:

a) providing (i) an elongated flat plate having obverse and reverse faces and a plurality of regularly spaced side-by-side rectangular openings wherein the spaces between the openings define transverse molding strips, the reverse face of the plate having an upper guide channel extending along the plate above the openings and a lower guide channel extending along the plate below the openings, and (ii) a plurality of tiles, each tile having an alpha-numeric indicia on an obverse face, top and bottom edges and parallel lateral side edges wherein the width of each tile as defined between the side edges is a distance less then the combined width of an opening and an adjacent transverse molding strip and greater than the width of an opening;

b) inserting the top and bottom edge of each tile into the upper and lower guide channels respectively with the obverse face of each tile against the reverse face of the plate;

c) sliding a plurality of tiles into the guide channels and abutting the lateral side edge of one tile to the lateral side edge of an adjacent tile to form an array of the tiles;

d) locating the abutting tiles in the array at an adjusted longitudinal position relative to the openings such that the indicia on each tile in the array is associated with and visible through one of the openings while the abutting tile edges are masked by said moldings;

e) crimping the guide channels at the outermost tiles of the array for fixing the array of tiles in the longitudinal adjusted position; and f) attaching the plate to a support surface with the reverse face of the plate against the support surface, whereby the indicia is visible through the opening while the edges of the tiles are masked by both the transverse molding strips and the portion of the plate obverse face adjacent the openings to inhibit exposure of the tile edges to vandal attack.

* * * * *